United States Patent [19]

Ross

[11] Patent Number: 4,535,842

[45] Date of Patent: Aug. 20, 1985

[54] WELL TOOL SETTING ASSEMBLY

[75] Inventor: Richard J. Ross, Houston, Tex.

[73] Assignee: Baker Oil Tools, Inc., Orange, Calif.

[21] Appl. No.: 510,210

[22] Filed: Jul. 1, 1983

[51] Int. Cl.[3] ..... E21B 23/04

[52] U.S. Cl. ..... 166/63; 166/123; 166/181; 166/383

[58] Field of Search ..... 166/383, 63, 123, 181, 166/332, 334

[56] References Cited

U.S. PATENT DOCUMENTS 2,618,343 11/1952 Conrad ..... 166/63
2,637,402 5/1953 Baker et al. ..... 166/123 X
2,799,343 7/1957 Conrad ..... 166/63
3,125,162 3/1964 Briggs, Jr. et al. ..... 166/123

*Primary Examiner*—Stephen J. Novosad
*Assistant Examiner*—William P. Neuder
*Attorney, Agent, or Firm*—Norvell & Associates

[57] ABSTRACT

A tool for actuating a subsurface well tool located within a well bore by metering the force applied by hydrostatic pressure within the well bore is disclosed. The tool is actuated in response to an external signal whereby hydrostatic pressure is applied to a hydraulic fluid contained within the tool. The hydraulic fluid is metered to apply a prescribed actuating force to a piston with a metering orifice determining the rate at which force is applied to the actuating piston and to the well tool.

6 Claims, 4 Drawing Figures

WELL TOOL SETTING ASSEMBLY

BACKGROUND OF THE INVENTION

1. Field of the Invention

This invention relates to a well tool for use in setting other well tools in anchoring or sealing engagement with a conduit in a subterranean well and, more particularly to, wireline setting assemblies used to set well tools, such as bridge plugs, packers and cement retainers.

2. Description of the Prior Art

Well tools, such as bridge plugs, packers and cement retainers used in subterranean oil and gas wells can be anchored or positioned at a subsurface location within the well conduit by a number of means. Some well tools can be set or anchored by means of mechanical manipulation of a tubing string extending from the well tool to the surface or by means of the application of hydraulic pressure through the contiguous tubing string. One common method of setting conventional well tools is by use of a wireline pressure setting assembly. Conventional wireline pressure setting assemblies can be attached to the conventional well tool and run into the well on a conventional wireline unit. When the well tool reaches the desired subsurface location, the wireline pressure setting assembly can be actuated to set the packer. Conventional wireline pressure setting assemblies employ a combustible or explosive powder charge which is actuated by means of an electric firing or triggering signal transmitted through an electric line extending to the surface of the well. Upon ignition of the powder charge contained in the well tool, the gases generated can be used to perform work in setting the well tool at the desired subsurface location.

Conventional well tools, such as bridge plugs, packers and cement retainers, employ longitudinally relatively shiftable sleeves or mandrels for use in setting the tool. By applying a downward force to one of two telescoping cylindrical members and an upward force to the other relatively telescoping cylindrical member or mandrel, an axially compressive force can be applied to anchoring slips or to sealing elements on the conventional well tool. Means can be provided to trap the initial movement of one cylindrical member relative to the other to secure the well tool in place within the well.

Conventional wireline pressure setting assemblies employ an axially shiftable piston responsive to the pressure of gases generated by the combustion or explosion of the powder charge. The movement of the piston in response to the expanding gas can then normally be transmitted by means of an appropriate connection to a sleeve in the conventional well tool. Another sleeve in the well tool can be attached to the cylindrical housing of the pressure setting assembly, and relative movement between the pressure setting piston and the pressure setting assembly housing will be transmitted to the relatively telescoping inner and outer cylindrical sleeves of the well tool and the well tool can be set.

Although the rate of combustion or explosion of the powder charge can be regulated to a certain degree, abrupt pressure changes can still result. These abrupt pressure changes could subject the actuating piston in the pressure setting assembly to rapid acceleration or jerks. One means of preventing such rapid acceleration is to provide a dash-pot assembly in which a suitable liquid, such as oil, is forced by movement of the actuating piston to flow at a relatively restricted rate through a port. Such dash-pot assemblies will therefore reduce the rate at which the actuating piston can be moved and will further increase the setting time for the tool. However, the rate of gas generation by the powder charge can be controlled only within certain limits and the generation of compressible gas to drive the piston will generally last only over a period of seconds, thus limiting the tool to fairly rapid actuation of the conventional well tool.

In some conventional wireline pressure setting assemblies, the forces generated by the expanding gases from the ignition of the powder charge is transmitted by means of a floating piston to a suitable liquid, such as oil, contained within an enclosed chamber. The forces transmitted to the incompressible liquid or oil are then transmitted to a separate piston attached to one of the cylindrical members in the conventional well tool. This separate piston has an atmospheric chamber located on its surface opposite the surface subjected to the force transmitted by the incompressible oil. The pressure differential will thus cause the piston to move to transmit a setting force to the attached well tool. A suitable dash-pot assembly may be incorporated within the enclosed chamber containing a hydraulic fluid to again act as a dash-pot, reducing acceleration of the actuating piston. It has been found that the orifice through which the incompressible fluid is shifted cannot be reduced in diameter sufficient to significantly increase the pressure setting time for conventional tools. A restriction of the orifice contained within the enclosed chamber results in a greater pressure within the chamber containing the expanding gas products of combustion or explosion of the powder charge. This increased pressure in turn results in a more rapid generation of combustion or explosion of the driving powder charge.

Although such conventional pressure setting assemblies have been successfully used in a wide variety of applications, there have been problems with conventional pressure setting assemblies used in very deep wells and at high temperatures exceeding 400°–450° F. At these temperatures, the powder charges or propellants, as well as ignition devices, may not ignite or burn satisfactorily. Pressure setting assemblies in which hydrostatic pressure is used to supply the actuating force have been suggested for use under these circumstances. In one device, a valve is shifted from a closed to an open position by hydrostatic pressure. Movement of the valve is possible by the disintegration of a material initially holding the valve in the closed position. When the valve is shifted to the open position, the hydrostatic pressure can act on an axially shiftable piston which transmits a setting force to the well tool in much the same manner as in more conventional powder charge driven apparatus. The pressure differential created by hydrostatic pressure acting on one surface of the actuating piston and atmospheric pressure acting on the other surface of the actuating piston is sufficient to drive the piston and to set the tool. Such tools can also be used in a tandem multi-piston configuration to multiply the total force which can be exerted by the apparatus in performing the setting operation. Although restricted flow passages can be used in the shiftable valve to reduce the flow rate of hydrostatic fluids, the degree of restriction is limited and such restricted flow passages are used to avoid the imposition of sudden or shock loads on the apparatus. In one version of such a hydrostatic pressure operated apparatus, the valve is subsequently fully opened after initially providing a restricted flow passage to minimize the initial shock loads when hydrostatic pressure is exerted upon the piston assembly. When the valve is subsequently fully open, the hydrostatic pressure acts on the actuating pistons without passing through any restricted flow passage.

In addition to the problems encountered with ignitors and powder charges at high temperatures, it is often necessary to set a packer at a much slower rate than is possible utilizing conventional pressure setting tools. For example, if a wireline packer employs a thermoplastic packing element, a relatively lengthy setting time is required. The rate of deformation of thermoplastic packing elements, such as Teflon packing element, which is necessary to establish a suitable seal, is slow relative to conventional setting times. A pressure setting assembly capable of exerting a setting force over a long period of time, of minutes or even hours rather than a few seconds as in conventional tools, is therefore highly desirable. Even with conventional packing elements, a tool set by a relatively lower force exerted over a relatively longer period of time can result in a better seal being established by the packing element. Furthermore, a pressure setting assembly capable of exerting pressure setting forces over a greater range than is currently available and for time periods varying from conventional setting times to longer periods would be highly desirable.

SUMMARY OF THE INVENTION

An apparatus and method for use in applying an actuating or setting force to a well tool, such as a packer, bridge plug or cement retainer can be disposed at a subsurface location and attached to the well tool. The actuating or setting tool has an outer cylindrical housing having at least one port extending from the exterior of the housing to a chamber within the housing. The port is closed as the tool is run into the well, and when the tool is positioned at the desired subsurface location within the well by a conventional wireline device, the port is opened in response to an external signal.

In the preferred embodiment of the invention, the external signal comprises an electrical signal for igniting a pyrotechnic charge to generate a rapidly expanding gas or a shock wave. The rapidly expanding gas shifts an internal piston to open at least one port. When the port is open, hydrostatic pressure in the well bore acts through the port on the piston and urges the piston into engagement with another piston. A hydraulic, preferrably incompressible, fluid is contained on the opposite side of the piston and hydrostatic force is applied through the piston to hydraulic fluid.

A device for metering the hydraulic fluid, comprising restricted metering passage, such as an orifice or tortuous fluid passageway in the preferred embodiment invention, meters the flow of the hydraulic fluid subjected to a hydrostatic pressure force. A prescribed pressure drop is established across the metering device such that the pressure of the hydraulic fluid downstream of the metering device is less than the pressure thereabove. The hydraulic pressure force below the metering device is then applied to one or more pistons and the differential between the downstream hydraulic pressure and a reference pressure, such as atmospheric, on the opposite side of the actuating pistons causes movement of the actuating piston relative to the actuating tool housing. Multiple stages may be employed to increase the area over which the pressure differential acts.

Movement of the actuating piston is applied by conventional means to the well tool. For example, in the preferred embodiment, a conventional cross-link arrangement results in the application of a downward force caused by movement of the actuating piston on an exterior sleeve in the well tool. The outer housing of the actuating tool is in turn attached to a concentric inner member of the well tool. The relative movement between the actuating piston and the actuating tool housing is then transferred to the well tool to set anchoring slips and packing elements in a conventional manner.

DETAILED DESCRIPTION OF THE PREFERRED EMBODIMENT

Figure 1A:
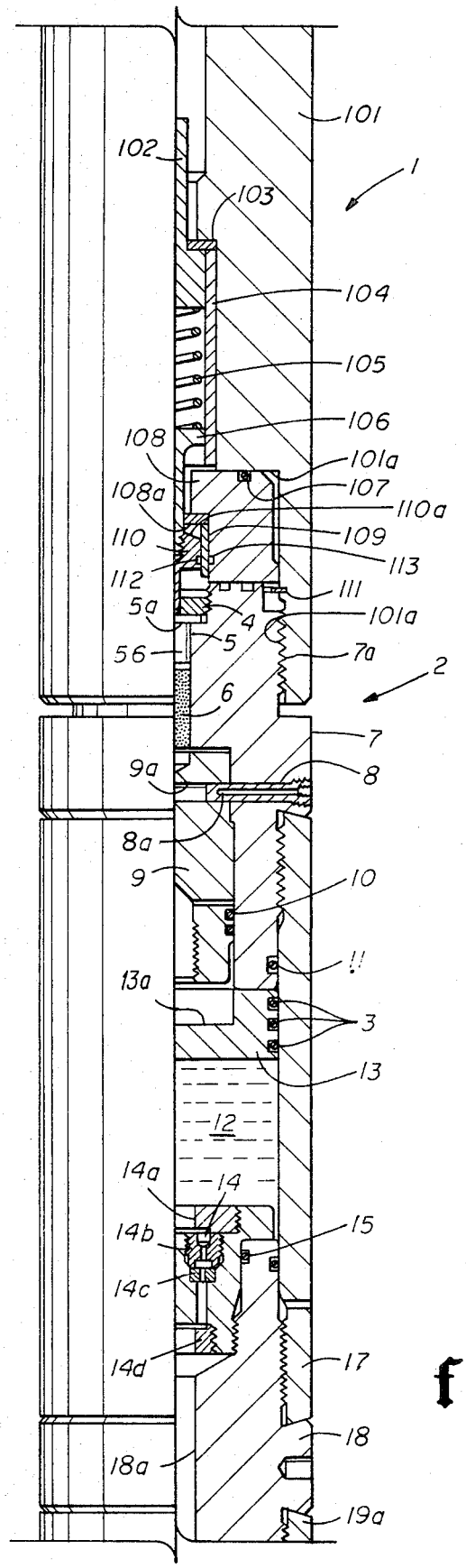
FIGS. 1A and 1B collectively constitute a longitudinal quarter-sectional view showing the wireline pressure setting assembly prior to actuation.

The preferred embodiment of this invention comprises a wireline pressure setting tool affixed to a firing head assembly and attached to a conventional wireline unit by conventional means similar to that shown in U.S. Pat. No. 3,220,480. The preferred embodiment of this invention comprises two separate component subassemblies, the firing head subassembly 1 and the pressure setting subassembly 2. The connection between the firing head and the conventional wireline equipment, including the electric line, is not shown, but this interconnection is in accordance with conventional practice.

The firing head subassembly 1 comprises a cylindrical head member 101 which can be attached to the conventional wireline assembly. The means of interconnection can be determined by the operator and the upper end of head 101 can be prepared as required by the operator. For example, suitable threads may be provided on the upper end of head 101. A firing pin connector 102 is positioned within the bore of cylindrical head 101. Again, firing pin connector 102 can be conventionally attached to an electric line in the wireline unit. An annular insulator 103 is positioned between the metallic head 101 and the firing pin connector 102 with axially facing shoulders on each member abutting opposite sides of insulator 103 in the unactuated configuration. An annular insulating sleeve 104 extends below insulator 103 around the exterior of firing pin connector 102 and within the bore of the firing pin head 101. Upper firing pin connector 102 is biased upwardly by means of a spring 105 relative to the lower pin connector 106. Both the upper and lower firing pin connectors 102 and 106 and spring 105 are generally contained within the annular insulating sleeve 104.

Figure 1B:
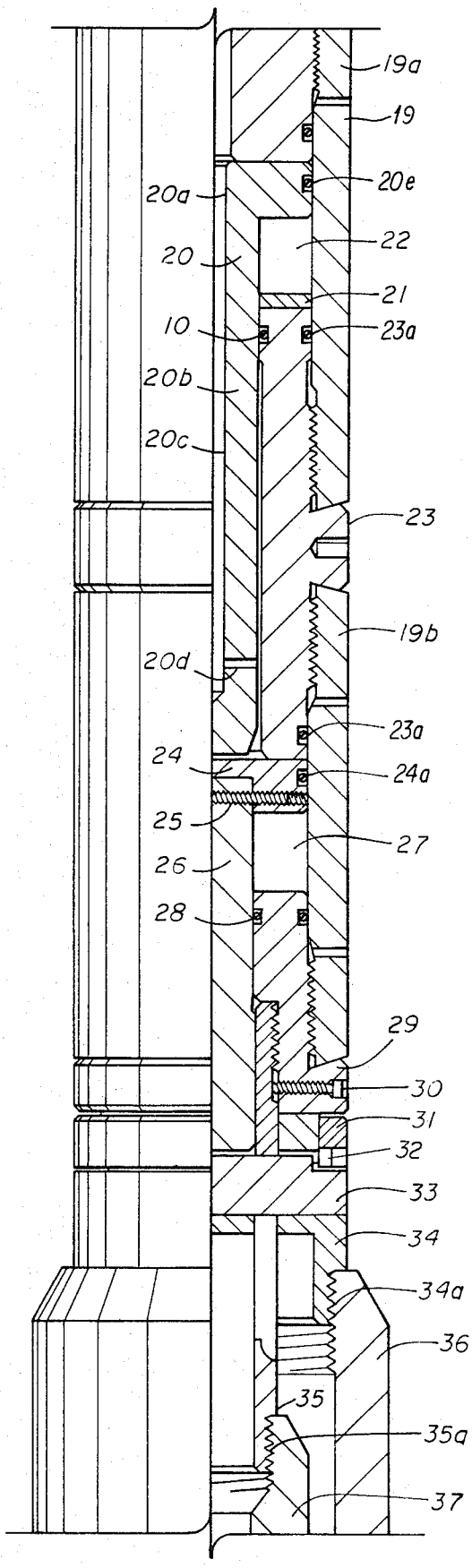

FIG. 1 shows both firing pin connectors in their upper unactuated positions. A seal insert 108 abuts a downwardly facing surface 101*a* on the firing pin head and is positioned around and below the lower firing pin connector 106. Sealing integrity is maintained between seal insert 108 and head 101 by means of an O-ring seal 107. Seal insert 108 does not contact lower firing pin connector 106 in the unactuated position of FIG. 1. A lower insulator sleeve 109 is positioned within the inner bore of seal insert 108 below a downwardly facing inner surface 108*a* on seal insert 108. Firing pin 110 is positioned with insulator sleeve 109 and is attached by means of a threaded connection to lower firing pin connector 106. An upwardly facing inclined surface 110*a* on firing pin 110 is positioned in opposed spaced apart relationship with respect to downwardly facing surface 108*a* on the seal insert when the firing pin is in the unactuated position of FIG. 1. O-ring seals 112 and 113 are positioned on opposite sides of lower insulator sleeve 109 to provide sealing integrity between the insulator and the seal insert and firing pin respectively. The firing pin connectors 102 and 106, spring 105 and firing pin 110 are each fabricated from an electrically conduitive metal capable of delivering an electrical current to actuate the pressure setting assembly. Firing pin 110 can be ideally formed of a suitable relatively soft material, such as brass.

The firing pin head subassembly 1 is attached to the pressure setting subassembly 2 by means of threaded connection between threads 101*a* and 7*a*. The upper portion of the pressure setting subassembly comprises a cylindrical shear housing 7 having external threads 7*a* and defining an inner bore for receipt of cylindrical ignitor 5 and powder charge 6. The charge 6 comprises a pyrotechnic charge which generates a rapidly expanding gas when ignited. The charge 6 is positioned in the lower portion of the bore in shear housing 7 and ignitor 5 comprising an upper cap section 5*a* and a lower cylindrical section 5*b* extending into the shear housing bore above the pyrotechnic charge is positioned to retain the charge therebelow. An ignitor lock nut 4 is positioned in engagement with internal threads on shear housing 7 to retain the ignitor and charge in position. Clearance is provided for movement of firing pin 110 downwardly through ignitor lock nut 4 into contact with ignitor 5 to "set off" the charge.

Shear housing 7 has a threaded port for receipt of a plug 8 extending radially therethrough from the exterior to the interior of the shear housing. Below the location of charge 6, shear housing 7 has an enlarged bore into which the lower portion of plug 8 extends. Plug 8 has an internal port extending partially therethrough with a closed end on the interior of the plug. The closed end and the internal port extend beyond the inner surface defining the lower enlarged bore of shear housing 7.

A first or upper portion 9 is positioned within the lower enlarged bore of shear housing 7. Annular sealing rings 10 establish sealing integrity between the exterior of the first or upper portion 9 and the interior of the lower bore of shear housing 7. Plug 8 extends into a bore 9*a* aligned with the port extending through shear housing 7. The inner evacuated bore port portion 8*a* extends partially into the aligned hole 9*a*.

A cylindrical outer housing 17 is attached below plug 8 to shear housing 7 by means of a conventional threaded connection. Sealing integrity is maintained between shear housing 7 and cylindrical housing 17 by means of an annular sealing member 11. A second piston 13 is located within the interior of cylindrical housing 17 initially in abutting relationship with the lower end of shear housing 7. Piston 13 has a plurality of annular seals, such as O-ring seals 3, for establishing sealing integrity between the interior cylindrical housing 17 and the shiftable piston 13. The upper surface of piston 13 is recessed to provide clearance between surface 13*a* and the lower end of upper piston 9 when the tool is in the position shown in FIG. 1A.

Cylindrical housing 17 is attached by means of a conventional threaded connection to a housing connector section 18 at its lower end. Connector housing 18 has an internal bore 18*a* along its middle and lower portions but has a means for receiving a metering device in an enlarged counter bore at its upper end. The metering subassembly comprises a metering cartridge subassembly which further comprises an upper section 14*a*, an intermediate ported section 14*b*, an orifice section 14*c* and a lower nut section 14*d*. The component sections of metering cartridge 14 are all threaded together and/or threaded to the connector housing 18*a* by means of conventional threaded connections as shown. Metering cartridge 14 defines a generally axially extending path from its upper to its lower surfaces. The metering cartridge defines an orifice of known dimensions significantly restricting the flow of a fluid therethrough. For example, the orifice section 14*c* may be a Visco-Jet manufactured by the Lee Company, Westbrook, Conn., having a tortuous fluid path or passageway. Other types and brands of orifices or flow control devices are commercially available and may be substituted for the Lee Visco-Jet. Nevertheless, a fluid flow path is defined through the metering cartridge. In order to maintain an open path through the metering cartridge, the hydraulic fluid may be filtered in a conventional manner.

Fluid reservoirs or cavities are defined above and below the metering cartridge 14. The upper fluid reservoir 12 is defined between the upper surface of connector housing 18*a* and the upper section of metering cartridge 14*a* and the lower surface of piston 13. Seals are provided between the metering cartridge and the metering connector 18 and between the connector 18 and the housing 17 preventing the passage of fluid along these mating surfaces. A lower reservoir is defined by the internal bore of connector housing 18*a* and this lower reservoir extends through bore 18*a* and into communication with a piston 20 located therebelow. The only communication between the upper fluid reservoir 12 and the bore 18*a* of connector housing 18 defining a portion of the lower reservoir is through the metering orifices defined by cartridge 14, which are adjustable and can be dimensioned to establish a prescribed flow rate and to establish a prescribed pressure drop across the metering orifice. In the preferred embodiment of this invention, a suitable hydraulic fluid or oil is contained within both fluid reservoir 12 and the lower fluid reservoir defined in part by the connector housing bore 18*a*.

A second cylindrical housing 19 having a conventional threaded connection is attached to the lowermost portion of connector housing 18*a* and extends downwardly therefrom. As shown in FIG. 1, an actuating piston 20 is located within upper housing portion 19*a* below connector housing 18. The upper surface of actuating piston 20 abuts the lower end of connector housing 18 in the unactuated position of FIG. 1. Piston 20 comprises an upper head 20*a* contiguous with the inner surface of housing 19, with a suitable annular sealing ring 20*e* maintaining sealing integrity. The lower portion 20*b* of actuating piston 20 has an outer diameter substantially less than the outer diameter of head portion 20*a* and extends axially beyond the lower portion of cylindrical housing 19. Cylindrical housing 19 is attached again by means of a conventional threaded connection to a cylindrical connector section 23 which has an internal bore contiguous with the external surface of the lower portion 20*b* of actuating piston 20. Sealing integrity is maintained between housing 19 and connector section 23, as well as between the actuating piston lower extension 20*b* and the connector 23 again by means of suitable annular sealing elements 23*a*. A spacer 21 is located at the upper end of cylindrical connector section 23 above the sealing rings 23*a* and below the lower surface of actuating piston head 20*a* to define an annular chamber or a reference pressure chamber 22 separate from the fluid pressure chamber defined by the internal bore 18*a* of connector housing 18 and the internal bore of 20*c* of actuating piston 20.

A lowermost piston assembly operable in conjunction with actuating piston 20 is defined by piston 24 which in the configuration of FIG. 1 is in abutting contact both with cylindrical connector 23 and the lower end of actuating piston 20. Fluid communication between the fluid reservoir defined by the internal bore of 20*c* of actuating piston 20 is provided by means of a radially extending port 20*d* located at the lowermost end of the internal bore 20*c* adjacent the lower end of the actuating piston 20. Sealing integrity is provided between connector housing 23 and a lower cylindrical housing section 19*b* by means of a suitable annular sealing element 23*a* in the same manner as sealing integrity is provided between the lowermost piston 24 and cylindrical housing 19*b* by O-ring 24*a*. Piston 24 is secured to a piston rod 26 by means of a set screw 25 extending therethrough. Piston 24 thus moves in conjunction with piston rod 26. A lowermost annular reference pressure chamber 27 is defined by piston rod 26, lowermost piston 24, the lower cylindrical housing 19*b* and lower cylinder head 29 attached to cylindrical housing 19*b*. Reference pressure chamber 27 is again isolated from the fluid pressure chamber defined by the internal bore on actuating piston 20 located above the piston 24.

Piston rod 26 is interconnected to an exterior cross-link sleeve 34 by means of a radially extending cross-link 33 extending through a slot in a setting mandrel 35 attached to cylinder head 29. This cross-link interconnection is equivalent to the cross-link connection contained in U.S. Pat. No. 3,208,355 and provides a means for transmitting the axial movement of the internal actuating piston to an outer connector while maintaining the inner setting mandrel 35 in an axially stationary configuration.

Cross-link sleeve 34*a* and setting mandrel 35 are attached to concentric tubular elements 36 and 37 of a wireline adaptor for use in setting a specific conventional well tool, such as a packer, bridge plug or cement retainer. These conventional well tools are generally set by opposite axial movement of inner and outer sleeves. For example, conventional packers and bridge plugs may be set by shifting an outer sleeve at the upper portion of the well tool downwardly while maintaining an inner sleeve in a stationary position or while moving the inner sleeve upward. Anchoring slips and annular packing elements may be urged outwardly into engagement with the outer well casing in this manner.

OPERATION

Figure 2A:
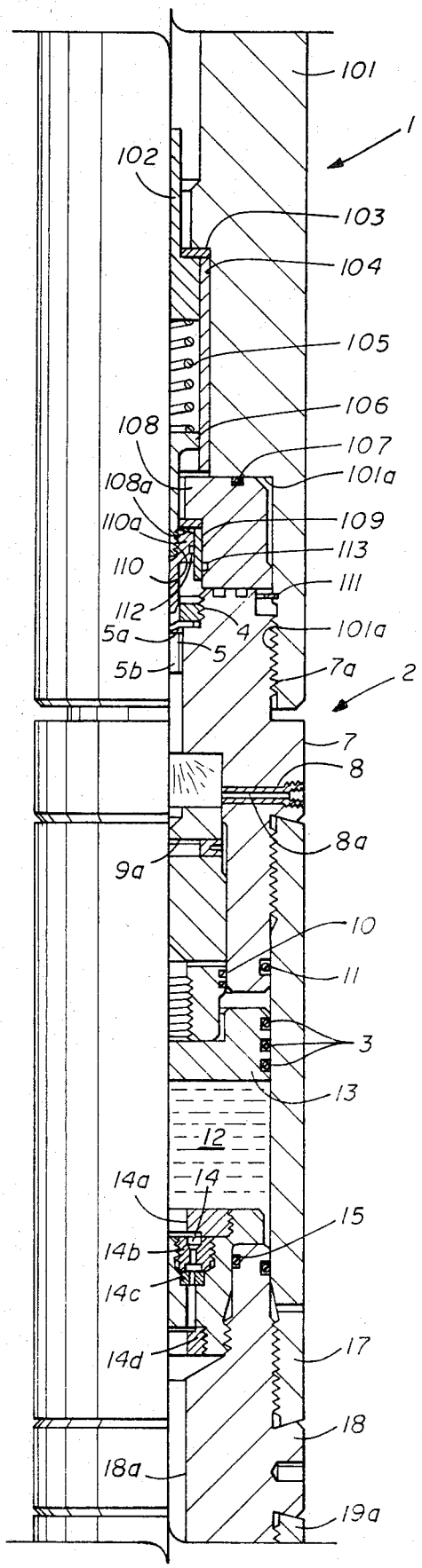
FIGS. 2A and 2B collectively constitute a longitudinal quarter-sectional view similar to FIG. 1 showing the wireline pressure setting assembly during actuation.
Figure 2B:
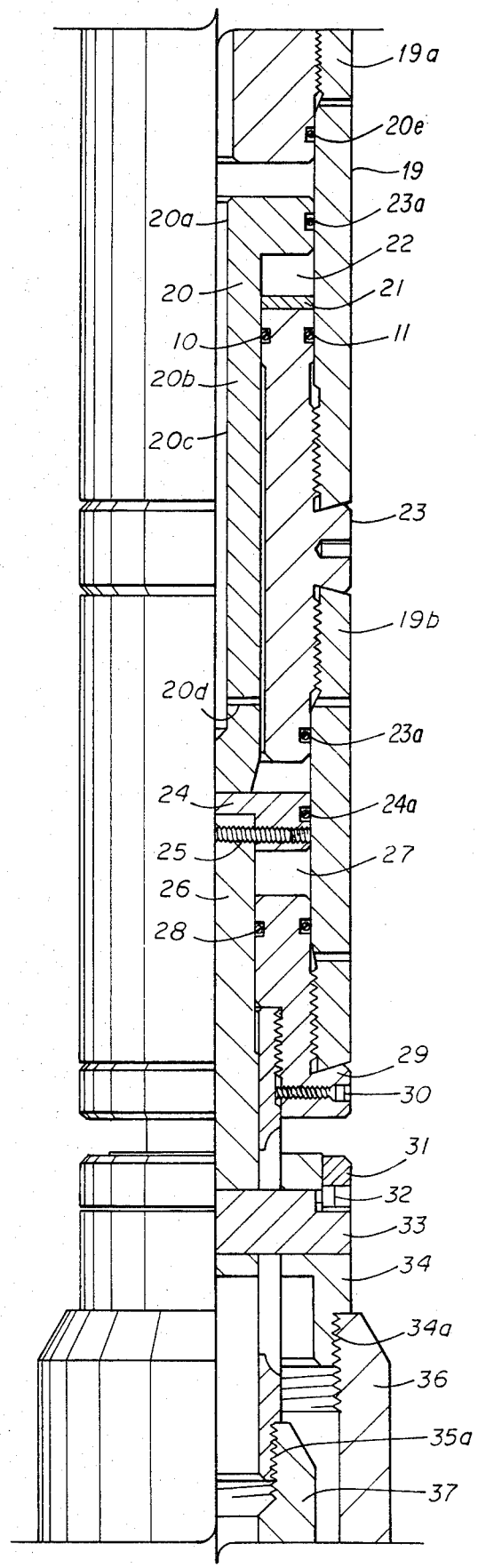

The pressure setting assembly 2 can be actuated by means of an external electrical signal transmitted through the conventional wireline tool. This electrical signal is used to ignite the charge 6 to begin the setting operation of the tool. Contact is maintained between the firing pin 110 and ignitor 5. When an electrical signal is passed through the ignitor 5, the ignitor will cause the pyrotechnic charge 6 to burn and generate a rapidly expanding gas. This expanding gas acts upwardly on the firing pin 110 to urge the firing pin upper surface 110 into contact with seal insert 108 along surface 108*a*, as shown in FIG. 2. A seal is established between this seal insert 108 and the soft brass of firing pin 110 to prevent the escape of gas and fluids upwardly past the firing pin. The rapidly expanding gas also exerts a pressure force on upper piston 9. This pressure force is sufficient to sever the outer end of plugs 8 thus permitting piston 9 to move downward relative to shear housing 7 and relative to piston 13. After piston 9 has moved downward below the severed plug 8, radial ports or passages are established through shear housing 7 to communicate between the exterior of the pressure setting tool and the interior of the bore of housing 7. The hydrostatic pressure at the subsurface location in the well bore can then act through port 8*a* on the upper surface of piston 9. Hydrostatic pressure also acts upwardly on firing pin 110 to maintain the firing pin in sealing contact with the seal insert 108 along surface 110*a*. Hydrostatic fluid cannot therefore leak upwardly past the firing pin head and affect the wireline tool.

As piston 13 is urged downwardly, first by the action of the rapidly expanding gas generated from ignition of the charge 6, the piston will act downwardly in abutting relationship on piston 9 which will then act downwardly on piston 13. Downward movement of these two upper pistons is resisted since an incompressible fluid, such as a hydraulic fluid or oil, is contained within fluid reservoir 12 and substantially fills that reservoir. The hydraulic fluid in reservoir 12 can only move downward through the metering orifice defined in metering cartridge 14. The rate of movement of fluid 12 through the orifice defined in metering cartridge 14 is prescribed and a prescribed pressure drop occurs as the fluid moves through the metering orifice in cartridge 14. The hydraulic fluid located within the lower fluid reservoir defined by the internal bores of 18*a* and 20*b* has a pressure equal to the difference between the initial pressure and the pressure drop through metering cartridge 14. This pressure below the metering cartridge acts to move the actuating piston 20 downwardly. A reference pressure in chamber 22 acts upwardly on actuating piston 20 and the difference in pressure between the reference pressure in chamber 22 and the hydraulic fluid pressure below metering cartridge 14 results in a downward force acting on actuating piston 20. In the preferred embodiment of this invention, the pressure in annular chamber 22 is atmospheric pressure. Piston 20 can then move downwardly relative to connector section 23. Downward movement of piston 24 also urges lowermost piston 20 and piston rod 26 downwardly by means of the abutting contact between the lower end of the actuating piston 20 and the lowermost piston 24. Communication between the inner bore 20*a* of actuating piston 20 and the piston 24 is provided by means of a radially extending port 20*d* located at the lower end of the actuating piston. The pressure of the hydraulic fluid below metering cartridge 14 can thus act on lowermost piston 24 to urge that piston downward relative to the outer housing 19. The pressure differential acting on lowermost piston 24 is equal to the difference in pressure between the hydraulic fluid immediately above piston 24 and the reference pressure within chamber 27. Normally the reference pressure within chamber 27 will be equal to atmospheric pressure. Use of two hydraulically actuated pistons 20 and 24 will result in a force multiplication in the same manner as the use of multiple pistons shown in U.S. Pat. No. 3,208,355. Since downward movement is transferred through the piston rod 26 into cross-link 33 and to the outer cross-link sleeve 34, the outermost sleeve of a conventional well tool attached to an adaptor sleeve 36 will move downward relative to the innermost sleeve attached to adaptor kit sleeve 37 which is in turn attached to the setting mandrel 35. In this way, a well tool may be set.

The principle driving force for setting the well tool is provided by the hydrostatic pressure at the subsurface location within the well bore. This pressure is not, however, transmitted immediately to the well tool since the hydrostatic pressure acts on a piston assembly in turn acting through a metered hydraulic fluid located within the pressure setting assembly. This assembly permits the ultimate setting force to be reduced relative to that which would exist by direct application of the hydrostatic pressure to the well tool. It is important, however, that the absolute value of the setting force applied be sufficient to shear an interconnection between the pressure setting assembly and the well tool when the well tool is firmly anchored in position. Furthermore, the rate at which the setting force is applied to the tool can be adjusted to account for the inability of certain relatively hard thermoplastic materials to be expanded in the same configuration in a rapid manner. The slower setting rates possible with this tool also facilitate the proper setting of other more conventional packing elements.

Although the invention has been described in terms of the specific embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for use in applying a force to a tool disposed at a sub-surface location in a well bore comprising:

a hollow housing having at least one port extending therethrough and communicable between the interior of the housing and the exterior well bore;

a valving piston axially shiftably mounted in the hollow housing for movement between a first position overlapping said port and a second position axially spaced from said port;

shearable means mounted in said port for closing said port and securing said valving piston in said first position;

means operating in response to an external signal for shifting said valving piston to said second position and thereby shearing said shearable means to open said port;

a first piston within the housing responsive to hydrostatic pressure in the well bore when the port is opened;

an actuating piston shiftable relative to the housing and having means for transmitting movement of the actuating piston to the well tool;

a hydraulic fluid disposed within the housing between the first piston and the actuating piston, the hydrostatic pressure force acting on the first piston being applied to the hydraulic fluid for driving the actuating piston; and metering means disposed between the first piston and the actuating piston for establishing a pressure drop thereacross and for reducing the flow rate of fluid therethrough during the period from initiation until completion of movement of the actuating piston, whereby the actuating force applied through the actuating piston, and the rate at which the well wool is actuated, are determined by the well bore hydrostatic force and the metering means.

2. The apparatus of claim 1 wherein the metering means comprises a metering orifice comprising a restricted tortuous flow path.

3. The apparatus of claim 2 wherein the actuating piston is shiftable in response to the difference between the pressure of the hydraulic fluid after passing through the metering orifice and a reference pressure.

4. The apparatus of claim 3 wherein the reference pressure is atmospheric pressure.

5. The apparatus of claim 1 wherein said shearable means comprises a hollow shear screw inserted through said port into said piston, whereby the shearing of said hollow shear screw opens a flow passage through shear screw.

6. An apparatus for use in applying a mechanical setting force to a tool disposed at a subsurface location in a subterranean well bore comprising:

a housing having means at one end thereof for attachment to the well tool;

a first piston disposed within a first cylinder defined by the housing;

at least one port extending through the housing and communicable with the first cylinder and the subterranean well bore, the first piston being shiftable from a first position in which the port is closed to a second position in which the port is open;

means for shifting the first piston from the first to the second position in response to an external signal;

a second piston shiftable relative to the housing and defining one end of the first cylinder;

a second cylinder defined on the end of the second piston opposite from the first cylinder;

a hydraulic fluid disposed in the second cylinder;

metering orifice means in the second cylinder for regulating the flow of the hydraulic fluid therethrough, with a pressure drop being maintained across the metering orifice means;

actuating piston means shiftable relative to the housing and disposed at the end of the second cylinder opposite from the second piston;

a reference pressure chamber within the housing with a surface on the actuating piston means opposite from the second cylinder defining one end of the reference pressure chamber, the pressure in the reference pressure chamber being lower than the hydrostatic pressure in the well bore; and means for transmitting forces from the actuating piston means to the well tool, whereby the first cylinder can be opened to the well bore and hydrostatic pressure applied to the hydraulic fluid in the second cylinder on one side of the metering means and with the pressure applied by the hydraulic fluid on the actuating piston means on the other side of the metering means being different from hydrostatic pressure so that the rate of movement transmitted by the actuating piston means to the tool is determined by the hydrostatic pressure acting in conjunction with the metering means.

* * * * *